US006180903B1

(12) United States Patent
Chen

(10) Patent No.: US 6,180,903 B1
(45) Date of Patent: Jan. 30, 2001

(54) TACT SWITCH

(75) Inventor: Chu-Mei Chen, Taipei (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/430,340

(22) Filed: Oct. 29, 1999

Related U.S. Application Data

(63) Continuation-in-part of application No. 09/384,477, filed on Aug. 27, 1999, now Pat. No. 6,018,132.

(51) Int. Cl.[7] ..... H01H 1/10

(52) U.S. Cl. ..... 200/406; 200/517; 200/573; 200/551

(58) Field of Search ..... 200/16 R–16 D, 200/405–409, 447, 449, 453, 520, 522, 517, 341, 533, 551, 275

(56) References Cited

U.S. PATENT DOCUMENTS 4,385,218 * 5/1983 Nishida ..... 200/159 B
4,405,845 * 9/1983 Kondo et al. ..... 200/67 DB
4,588,877 * 5/1986 Mizuta et al. ..... 200/67 DB
5,660,272 * 8/1997 Janniere et al. ..... 200/517
6,018,132 * 1/2000 Chen ..... 200/406

* cited by examiner

*Primary Examiner*—Michael Friedhofer
(74) *Attorney, Agent, or Firm*—Wei Te Chung

(57) ABSTRACT

A tact switch comprises an insulative base having contacts partially retained therein and partially exposing to exterior, wherein the exposed portions of the contacts face upward. Two separated steps are formed in the insulative base and located beyond the exposed portions of the contacts. A conductor plate has a frame positioned on the separated steps, an integral contacting portion surrounded by the frame and connected to the frame via two spring arms. Normally, the contacting portion registers with and separates from the exposed portion of the contacts. An elastic device is positioned on the conductor plate and it is deformable by depression thereon to thus deform the spring arms of the conductor plate and move the contacting portion of the conductor plate downward to electrically connect the exposed portions of the separated contacts simultaneously. The contacting portion of the conductor plate separates from the exposed portions of the separated contacts when the depression on the elastic device is released.

10 Claims, 10 Drawing Sheets

TACT SWITCH

This is a continuation-in-part of the application Ser. No. 09/384,477 filed Aug. 27, 1999, now U.S. Pat. No. 6,018,132.

BACKGROUND OF THE INVENTION

1. Field of the Invention

The present invention relates to a tact switch in which a plurality of separate contacts may be electrically connected together with relative short transmission path via operation on the tact switch.

2. The Related Art

Tact switches which have quick response to a manual depression have been used in many appliances such as in telephone sets, microwaves, remote controls, digital camera, TV sets, and etc. The inventor of the present invention has applied an U.S. patent application Ser. No. 09/384477 which is enclosed herein and shown in FIGS. 3, 4, 5 and 12. The tact switch as disclosed in U.S. application Ser. No. 09/384477 comprises a metal cover 1, a pusher 2, a support 3, a water-proof tape 4, a metal dome 5, a conductor plate 6, and a base 7. Referring to FIGS. 12 and 3, the metal cover 1 has a rectangular plate 10 from front and rear edges of which four tangs 11 extend downward, and from side edges of which two tabs 12 extend downward, wherein the tangs 11 extending from the front edge of the rectangular plate 10 are spaced from each other with a predetermined distance. Each tang 11 has a laterally extended portion 111 extending from one end thereof. A lever 13 extends from the rear edge of the plate 10 having a curved shape under the plate 10 and including an upper contacting portion 131 proximate to the plate 10 and a lower depressing portion 132 defined adjacent to a curved end 133 thereof.

Also referring to FIG. 4, the pusher 2 has a T-shaped body 21, a touch pad 22 integrated with a neck portion of the T-shaped body 21, a pair of outer fingers 23 and a pair of inner fingers 24 extending horizontally from a wide rear edge of the T-shaped body 21. A ramp 25 is formed in a middle portion of the rear edge substantially between the inner fingers 24. The outer finger 23 is longer than the inner finger 24. Rails 241 and 211 are respectively formed on top surfaces of the inner fingers 24 and the T-shaped body 21.

The support 3 is a metal plate having a cutout 30 defined from a rear edge thereof. A pair of first tabs 31 extend upward from opposite edges of the cutout 30 and each of the first tabs 31 is positioned between one pair of the outer finger 23 and the inner finger 24 for guiding the movement of the pusher 2. A pair of second tabs 32 extend upward from a front edge of the support 3. The metal dome 5 has an upper central area 51 having a rectangular shape and substantially at the top of the metal dome 5. The water-proof tape 4 is made of insulative material and adhered to the upper central area 51 of the metal dome 5. The conductor plate 6 has four spring arms 61 defined in a middle area thereof, and each spring arm 61 has a downwardly bent end 611.

Also referring to FIG. 5, the base 7 has four contacts 74 partially embedded in a dielectric housing 72 by insert molding. The housing 72 has a periphery wall 71 enclosing therearound thereby defining a cavity (not labeled) therein. Steps 73 are formed on opposite sides of the bottom surface (not labeled) of the cavity and four contacting portions 741 of the contacts 74 expose to external from the bottom surface of the cavity. The periphery wall 71 has an upper surface 751 which is higher than the steps 73. Two U-shaped upper walls 75 extend upward from the periphery wall 71 and define a front entrance 76 and a rear entrance (not labeled) therebetween.

Four shallow portions 710 are defined in front and rear sides of the periphery wall 71 for engagement with the bent ends 111 of the tangs 11 of the metal cover 1. Two grooves 750 are formed in opposite sides of the U-shaped upper walls 75 for engagement with the tabs 12 of the metal cover 1.

In assembling, the conductor plate 6 is positioned on the two steps 73, the metal dome 5 to which the central portion of the water-proof tape 4 adheres is positioned on the conductor plate 6. Edge portion of the water-proof tape 4 is attached on the upper surface 751 of the periphery wall 71 preventing water from entering the cavity surrounded by the periphery wall 71. The support 3 is positioned on the upper surface 751 of the periphery wall 71, with the second tabs 32, the side edges, and the rear edge thereof being retained between inner surfaces of the U-shaped upper walls 75. The pusher 2 is positioned on the support 3, with the first tabs 31 of the support 3 being retained in each pair of the outer finger 23 and the inner finger 24 of the pusher 2 and the outer fingers 23 thereof being spaced from the U-shaped upper walls 75 of the base 7 with a predetermined distance. Finally, the metal cover 1 is assembled onto the base 7 by engaging the bent ends 111 of the tangs 11 within the shallow portions 710 of the periphery wall 71, and engaging the tabs 12 thereof with the grooves 750 of the periphery wall 71, meanwhile the upper contacting portion 131 of the lever 13 abuts against the ramp 25 of the pusher 2, and the lower pressing portion 132 of the lever 13 movably surrounded by the inner periphery of the cutout 30 of the support 3.

During operation, the pusher 2 is pressed horizontally by a user until the outer fingers 23 thereof abuts against the U-shaped upper walls 75 of the base 7. Upon depression on the pusher 2, the ramp 25 moves forward to drive the lever 13 of the metal cover 1, thereby forcing the lower pressing portion 132 of the lever 13 to depress the metal dome 5, which in turn depresses the conductor plate 6 and causes the spring arms 61 and their bent ends 611 to electrically connect to the contacting portions 741 of the contacts 74, thereby simultaneously and electrically connecting the four contacts 74. When the metal dome 5 is depressed to force the conductor plate 6 to connect the contacting portions 741 of the contacts 74, the user will have a "click" feeling due to the deformation of the metal dome 5. A reverse operation occurs when the depression on the pusher 2 is released, and the four contacts 74 recover to electrical disconnection status.

Although the previous tact switch disclosed in the copending parent application, works well, a conductive path defined in each spring arm 61 and the outer periphery of the conductor plate 6 for electrically connecting the four contacts 74 is relatively long which will affect the response time of the tact switch. Moreover, if the metal dome 5 does not depress the four spring arms 61 simultaneously, the electrical connection of the four contacts 74 may not be achieved. It is requisite to provide a new structure to solve the above problems.

SUMMARY OF THE INVENTION

The primary purpose of the present invention is to provide an improved tact switch which can provide a reliable connection effect to a plurality of normally separated contacts therein.

Another purpose of the present invention is to provide an improved tact switch which can provide a relatively short conductive path for electrically connecting a plurality of normally separated contacts therein.

According to one aspect of the present invention, a tact switch comprises an insulative base having contacts partially retained therein and partially exposing to exterior, wherein the exposed portions of the contacts face upward. Two separated steps are formed in the insulative base and located beyond the exposed portions of the contacts. A conductor plate has a frame positioned on the separated steps, an integral contacting portion surrounded by the frame and connected to the frame via two spring arms. Normally, the contacting portion registers with and separates from the exposed portion of the contacts. An elastic device is positioned on the conductor plate and it is deformable by depression thereon to thus deform the spring arms of the conductor plate and move the integral contacting portion of the conductor plate downward to electrically connect the exposed portions of the separated contacts simultaneously. The contacting portion of the conductor plate separates from the exposed portions of the separated contacts when the depression on the elastic device is released.

DETAILED DESCRIPTION OF THE PREFERRED EMBODIMENT

Figure 1:
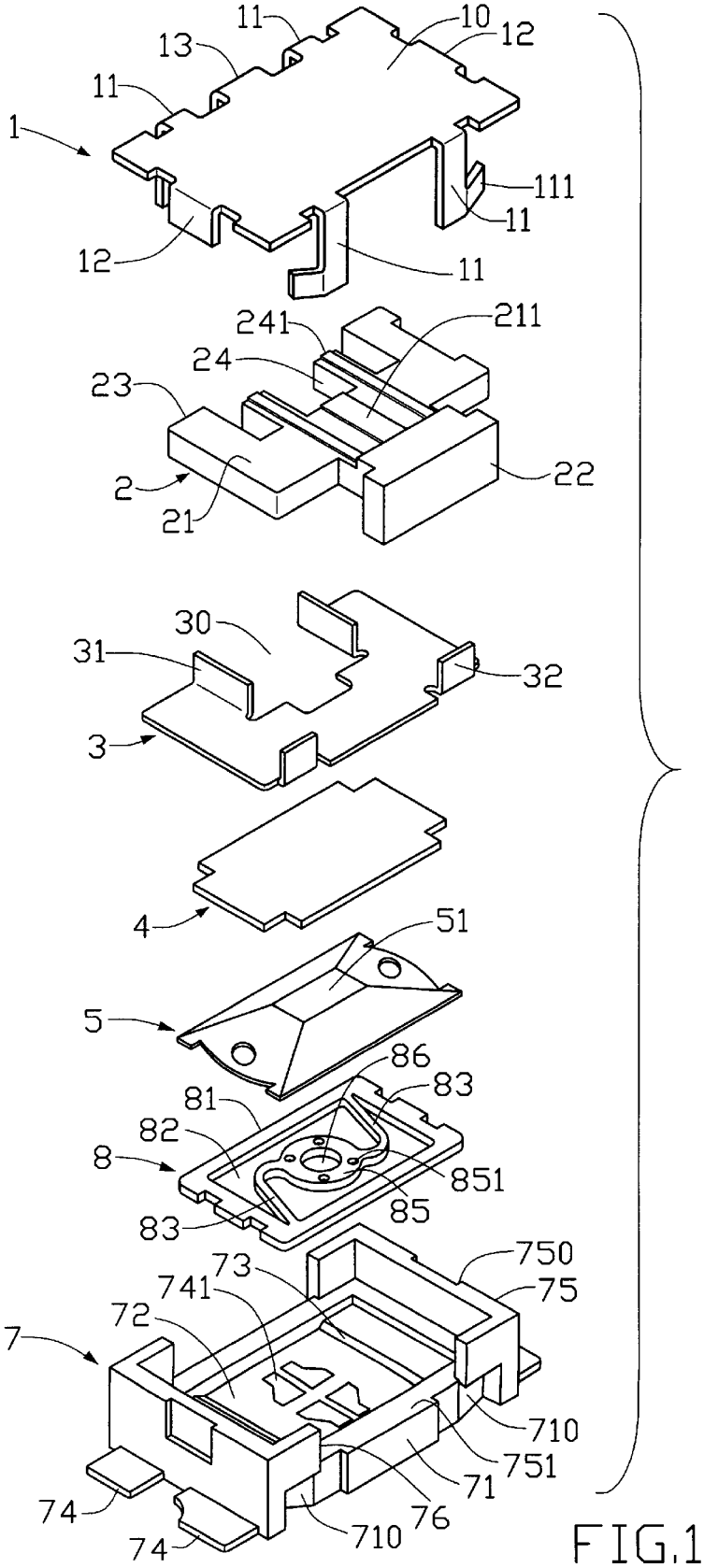
FIG. 1 is an exploded view of a horizontal tact switch in accordance with the present invention.

The present invention focuses on the improvement of the conductor plate 6 of U.S. application Ser. No. 09/384477, therefore the same parts thereof including the metal cover 1, the pusher 2, the support 3, the water-proof tape 4, the metal dome 5, and the base 7 will not be detailedly repeated herein. Referring to FIG. 1, an improved conductor plate 8 in accordance with the present invention is a metal plate made by stamping and comprises a frame 81 in which a space 82 is defined, a contacting plate 85 defining a hole 86 therein and having a circular shape connected to the frame 81 via two spring arms 83 which extend from diametric ends of the contacting plate 85. The contacting plate 85 may also be formed rectangular rather than circular. Each spring arm 83 is formed curved for increasing its flexibility when it is deformed. The "click" feeling when depressing the metal dome 5 may be maintained if the conductor plate 8 has a relatively high flexibility. Four protrusions 851 extend downwardly from the contacting plate 85.

Figure 2:
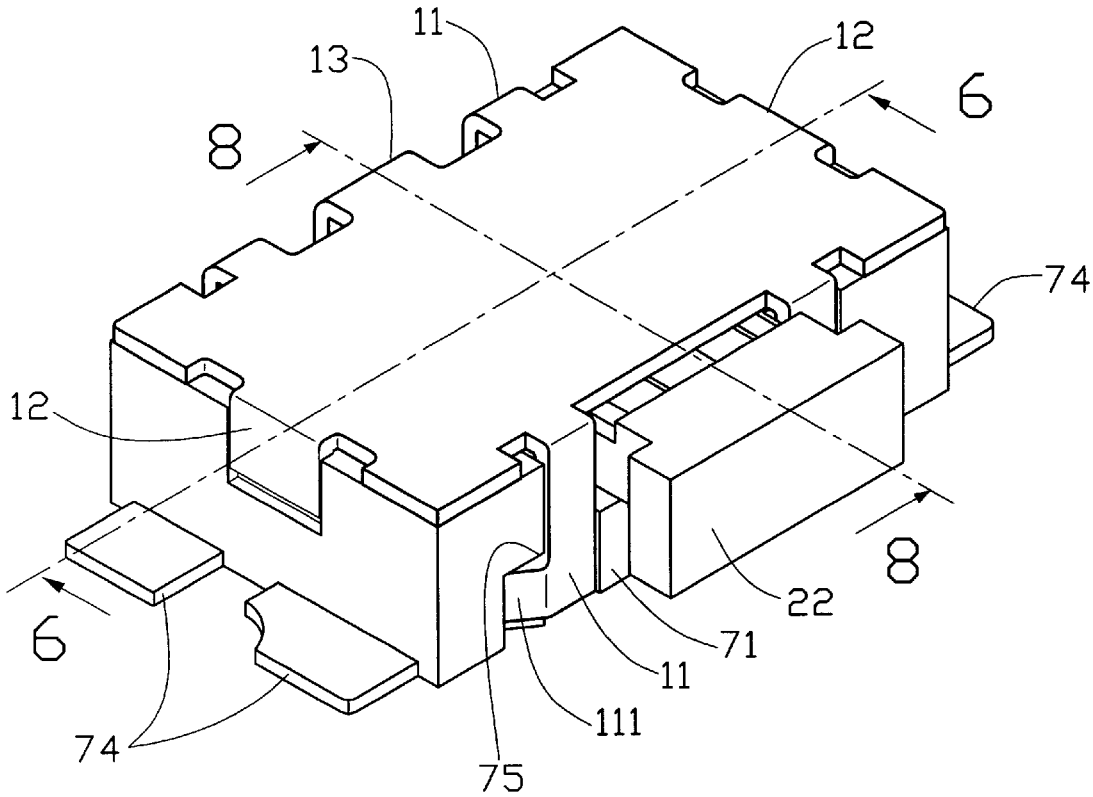
FIG. 2 is an enlarged assembled view of FIG. 1.
Figure 3:
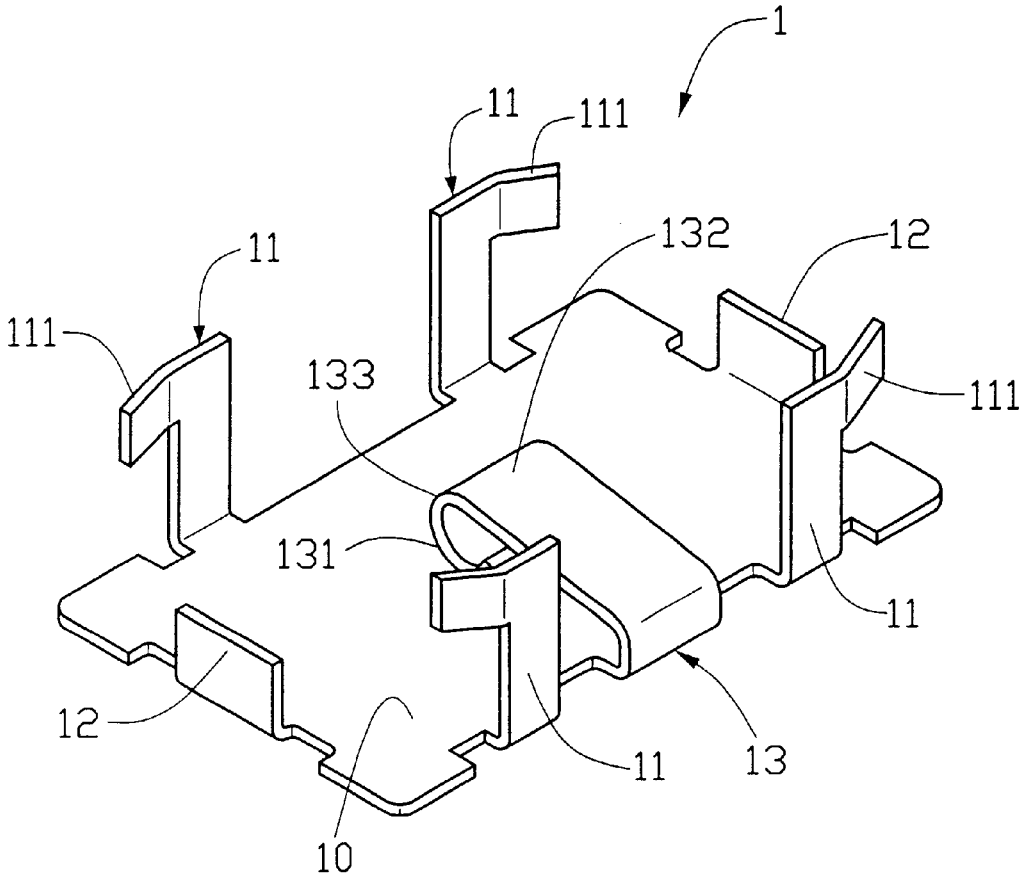
FIG. 3 is a perspective view of a prior metal cover of FIG. 12 taken from an opposite direction for showing a lever thereof.
Figure 4:
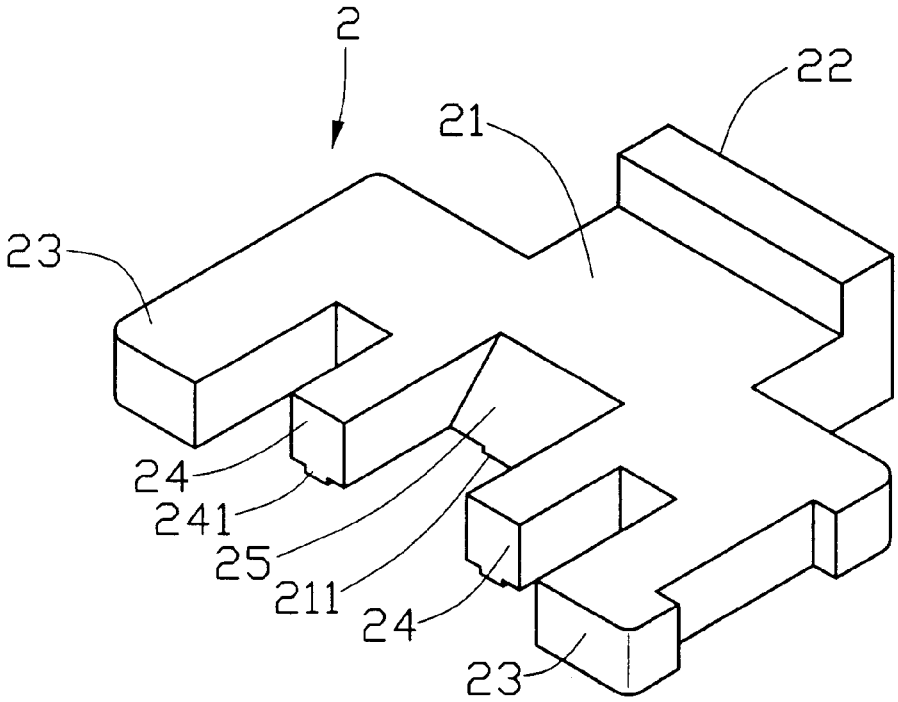
FIG. 4 is a perspective view of a prior pusher of FIG. 12 taken from an opposite direction for showing a ramp thereof.
Figure 5:
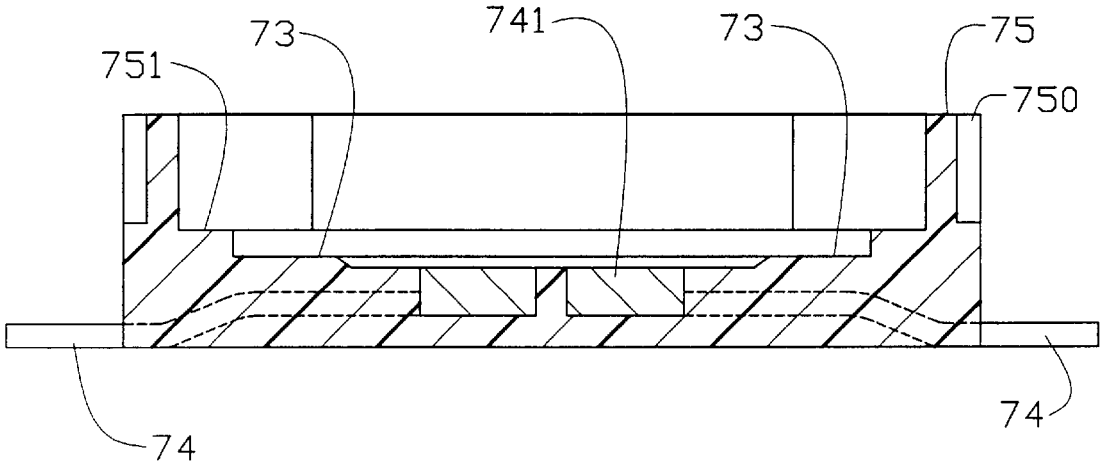
FIG. 5 is a cross-sectional view of the prior base of FIG. 12.
Figure 6:
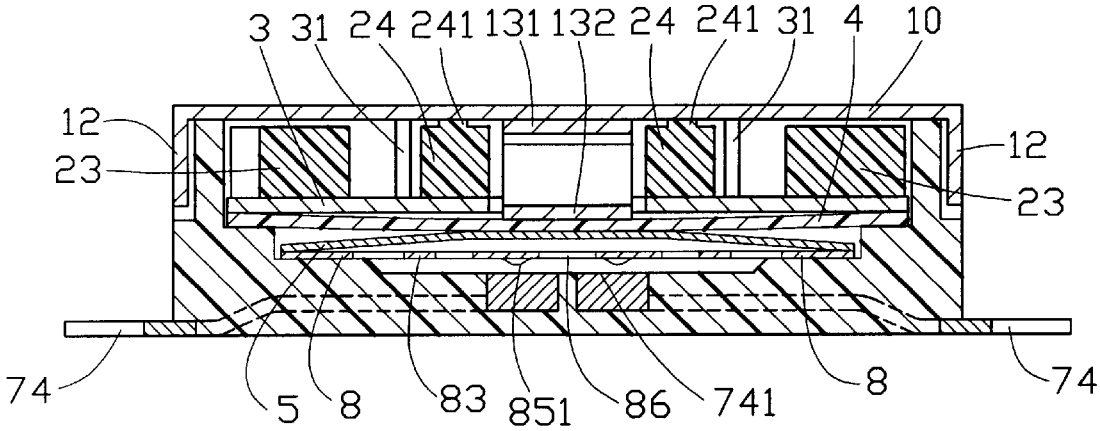
FIG. 6 is a cross-sectional view taken from line 6—6 of FIG. 2 showing a conductor plate not deformed.
Figure 8:
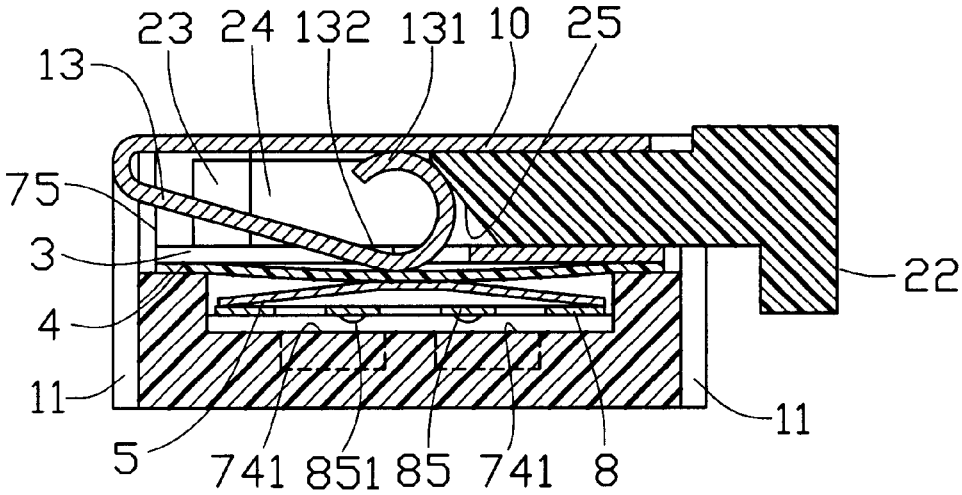
FIG. 8 is a cross-sectional view taken from line 8—8 of FIG. 2 showing a conductor plate not deformed.

The assembling procedures of the parts 1, 2, 3, 4, 8, 7 are the same to those shown in U.S. application Ser. No. 09/384477 and omitted herein. The assembled tact switch is shown in FIG. 2 which remains in an open status in which the contacts 74 are electrically separated. Particularly referring to FIGS. 6 and 8, after the tact switch is assembled and remains in the open status, the conductor plate 8 is positioned on the two steps 73 with the protrusions 851 thereof pointing toward yet not touching the contacting portions 741 of the contacts 74. The metal dome 5 to which the central portion of the water-proof tape 4 adheres is positioned on the conductor plate 8. Edge portion of the water-proof tape 4 is attached on the upper surface 751 of the periphery wall 71 preventing water from entering the cavity surrounded by the periphery wall 71. The support 3 is positioned on the upper surface 751 of the periphery wall 71, with the second tabs 32, the side edges, and the rear edge thereof being retained between inner surfaces of the U-shaped upper walls 75. The pusher 2 is positioned on the support 3, with the first tabs 31 of the support 3 being retained in each pair of the outer finger 23 and the inner finger 24 of the pusher 2 and the outer fingers 23 thereof being spaced from the U-shaped upper walls 75 of the base 7 with a predetermined distance. The metal cover 1 is assembled on the base 7 by engaging the bent ends 111 of the tangs 11 within the shallow portions 710 of the periphery wall 71, and engaging the tabs 12 thereof with the grooves 750 of the periphery wall 71. The upper contacting portion 131 of the lever 13 abuts against the ramp 25 of the pusher 2, and the lower pressing portion 132 of the lever 13 movably surrounded by the inner periphery of the cutout 30 of the support 3.

Figure 7:
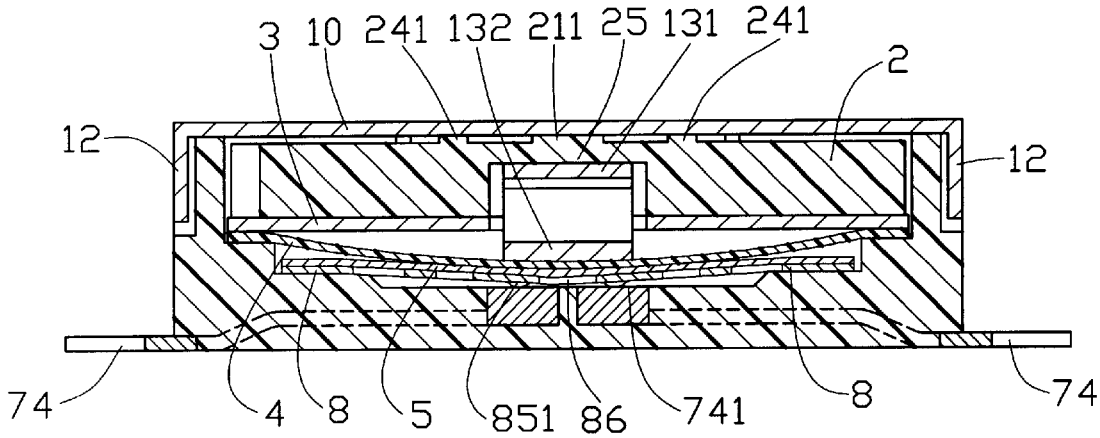
FIG. 7 is a schematic view showing the conductor plate of FIG. 6 deformed.
Figure 9:
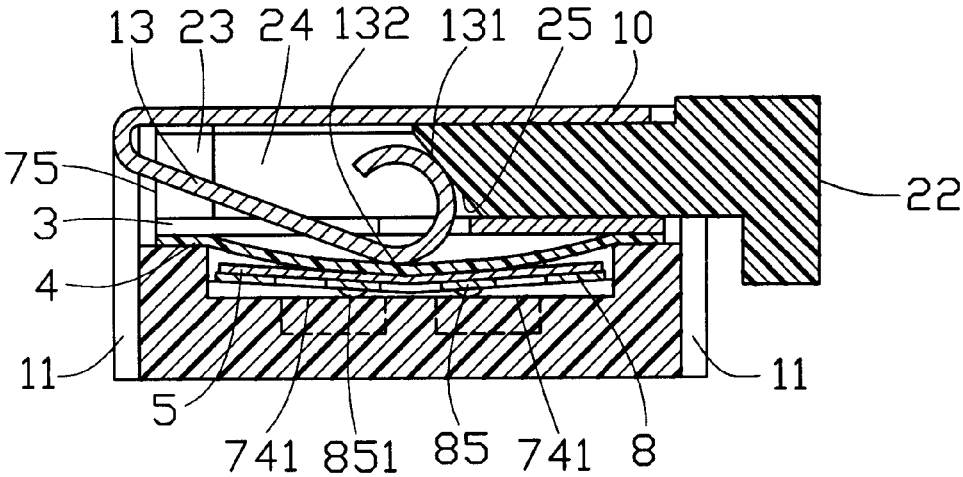
FIG. 9 is a schematic view showing the conductor plate of FIG. 8 deformed.

Referring to FIGS. 7 and 9, during operation, the pusher 2 is pressed horizontally by a user until the outer fingers 23 thereof abuts against the U-shaped upper walls 75 of the base 7 (FIG. 9). Upon depression on the pusher 2, the ramp 25 moves forward to drive the lever 13 of the metal cover 1, thereby forcing the lower pressing portion 132 of the lever 13 to depress the metal dome 5, which in turn depresses the conductor plate 8 especially the contacting plate 85 thereof thus causing the protrusions 851 to electrically connect to the contacting portions 741 of the contacts 74, thereby simultaneously and electrically connecting the four contacts 74. A reverse operation occurs when the depression on the pusher 2 is released, and the four contacts 74 recover to open status.

Figure 10:
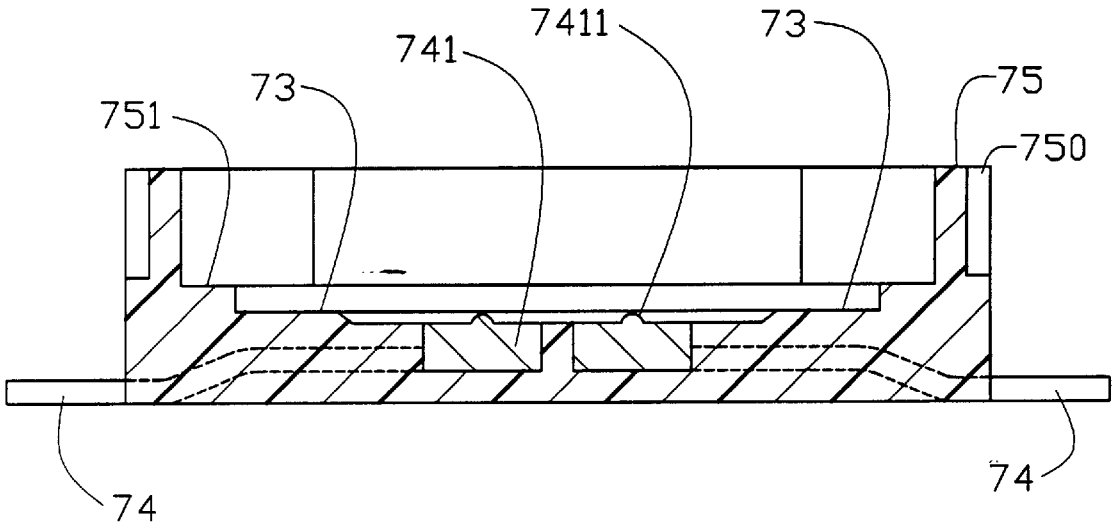
FIG. 10 is a second embodiment of the base of the present invention.
Figure 11:
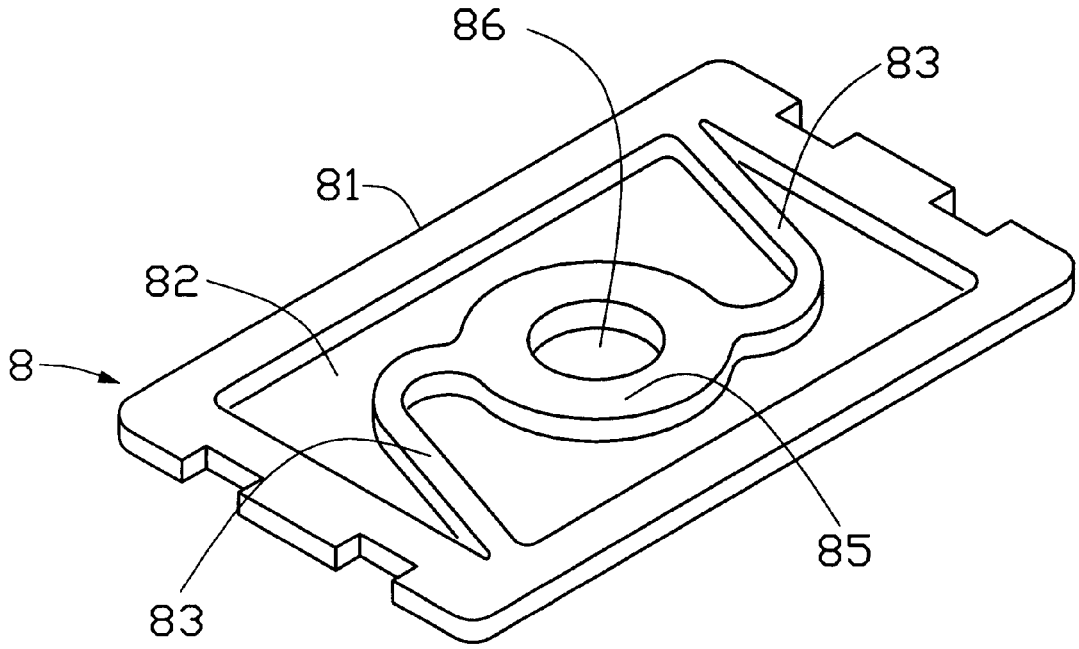
FIG. 11 is a second embodiment of the conductor plate of the present invention.
Figure 12:
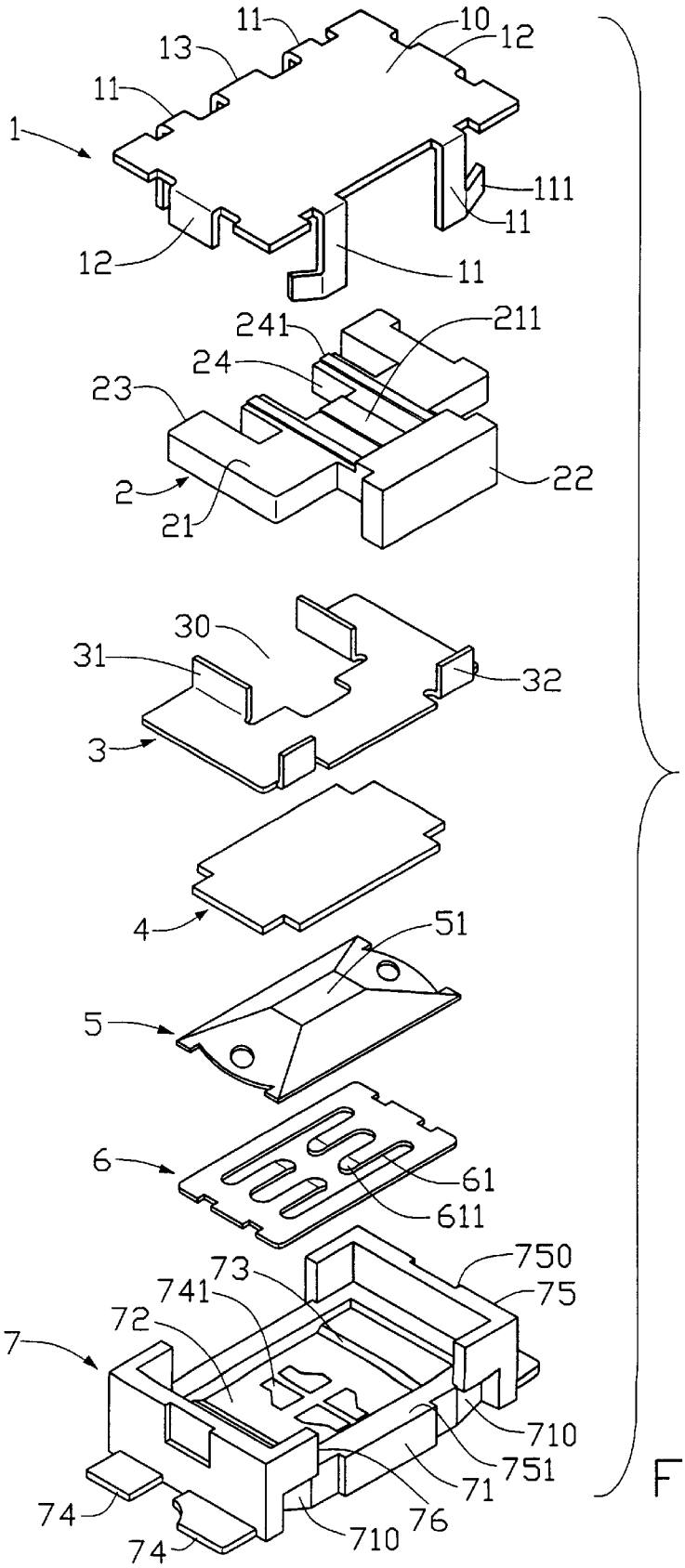
FIG. 12 is an exploded view of a prior tact switch.

In a second embodiment, the protrusions 851 of the conductor plate 8 may be omitted, while protrusions 7411 may be formed at the top surface of the contacting portions 741 of the contacts 74 as shown in FIGS. 10 and 11. In practice, the second embodiment works well too.

While the present invention has been described with reference to a specific embodiment, the description is illustrative of the invention and is not to be construed as limiting the invention. Therefore, various modifications to the present invention can be made to the preferred embodiment by those skilled in the art without departing from the true spirit and scope of the invention as defined by the appended claims.

What is claimed is:

1. A tact switch comprising:

an insulative base having separated contacts each of which has an exposed portion exposed to exterior, wherein the exposed portions of the separated contacts face upward;

two separated steps formed in the insulative base and located beyond the exposed portions of the contacts;

a conductor plate having a frame positioned on the separated steps, an integral contacting portion surrounded by the frame and connected to the frame via two spring arms, normally the integral contacting portion registering with and spaced away from the exposed portion of the contacts; and an elastic means positioned on the conductor plate;

wherein the elastic means is deformable by depression thereon to thus deform the spring arms of the conductor plate and move the integral contacting portion of the conductor plate downward to electrically connect the exposed portions of the separated contacts simultaneously, and when the depression on the elastic means is released, both the elastic means and the spring arms of the conductor plate will recover from deformation and the integral contacting portion of the conductor plate separates from the exposed portions of the separated contacts; and wherein the elastic means is a metal dome.

2. The tact switch as claimed in claim 1, wherein the integral contacting portion of the conductor plate has a plurality of protrusions extending downward each for connecting to the exposed portion of each of the contacts when the conductor plate is depressed by the elastic means.

3. The tact switch as claimed in claim 2, wherein the integral contacting portion has a hole defined in the center thereof.

4. The tact switch as claimed in claim 1, wherein the integral contacting portion has a circular shape and the spring arms extend from diametrical ends of the contacting portion.

5. The tact switch as claimed in claim 1, wherein the spring arms are curved.

6. The tact switch as claimed in claim 1, wherein the insulative base comprises a periphery wall located higher than the steps for retaining the elastic means and the conductor plate therein.

7. The tact switch as claimed in claim 6 further comprising an insulative water-proof tape attached to an upper surface of the periphery wall and a top surface of the elastic means.

8. A tact switch comprising:

an insulative base having separated contacts each of which has an exposed portion exposed to exterior, wherein the exposed portions of the separated contacts face upward;

two separated steps formed in the insulative base and located beyond the exposed portions of the contacts;

a conductor plate having a frame positioned on the separated steps, an integral contacting portion surrounded by the frame and connected to the frame via two spring arms, normally the integral contacting portion registering with and spaced away from the exposed portion of the contacts; and an elastic means positioned on the conductor plate;

wherein the elastic means is deformable by depression thereon to thus deform the spring arms of the conductor plate and move the integral contacting portion of the conductor plate downward to electrically connect the exposed portions of the separated contacts simultaneously, and when the depression on the elastic means is released, both the elastic means and the spring arms of the conductor plate will recover from deformation and the integral contacting portion of the conductor plate separates from the exposed portions of the separated contacts; and wherein the insulative base comprises a periphery wall located higher than the steps for retaining the elastic means and the conductor plate therein.

9. The tact switch as claimed in claim 8, wherein the elastic means is a metal dome.

10. The tact switch as claimed in claim 8 further comprising an insulative water-proof tape attached to an upper surface of the periphery wall and a top surface of the elastic means.

* * * * *